US005498181A

United States Patent [19]

Anselm et al.

[11] Patent Number: 5,498,181

[45] Date of Patent: Mar. 12, 1996

[54] OUTBOARD MOTOR POWER HEAD ASSEMBLY

[75] Inventors: Michael C. Anselm, Fort Myers, Fla.; James S. Nerstrom, Green Oaks, Ill.

[73] Assignee: Outboard Marine Corporation, Waukegan, Ill.

[21] Appl. No.: 254,999

[22] Filed: Jun. 7, 1994

[51] Int. Cl.[6] ..... B63H 5/12

[52] U.S. Cl. ..... 440/53; 440/77; 440/88; 440/89

[58] Field of Search ..... 440/49, 53, 63, 440/84, 85, 88, 89, 77

[56] References Cited

U.S. PATENT DOCUMENTS

| | | | |
|---|---|---|---|
| 2,905,130 | 9/1959 | Harrison | 440/85 |
| 3,692,006 | 9/1972 | Miller et al. | 440/89 |
| 3,839,986 | 10/1974 | Meyer et al. | 440/61 |
| 4,064,823 | 12/1977 | Draxler | 440/85 |
| 4,554,892 | 11/1985 | Amemori et al. | 440/89 |
| 4,594,970 | 6/1986 | Baars et al. | 123/73 |
| 4,846,300 | 7/1989 | Boda | 440/88 |
| 4,951,465 | 8/1990 | Torigai | 440/89 |
| 4,993,369 | 2/1991 | Breckenfeld et al. | 123/52 |
| 5,049,100 | 9/1991 | Yamamoto et al. | 440/89 |

*Primary Examiner*—Stephen Avila
*Attorney, Agent, or Firm*—Michael, Best & Friedrich

[57] ABSTRACT

Disclosed herein is an outboard motor including a fore and aft center plane and comprising a powerhead assembly including a two stroke internal combustion engine including a cylinder block including a port side, a starboard side, a plurality of vertically aligned cylinders in a single bank, which cylinders each include an axis extending at an angle to said center plane and to one of said port and starboard sides, and an exhaust port on the other of said port and starboard sides, and an exhaust gas passage including a main portion extending vertically adjacent said center plane, and a like plurality of elbow portions connecting said exhaust ports to said main portion, which elbow portions include any one change in direction.

20 Claims, 4 Drawing Sheets

351
161
147
145
357
201
203
6
6
149
187
185
151
159
173
171
156
49
183
184
193
197
95
181
157
117
97
191
165
377
379
381
383
301
199
195
69
71
115
101
103
105
303
119

OUTBOARD MOTOR POWER HEAD ASSEMBLY

BACKGROUND OF THE INVENTION

The invention relates generally to outboard motors and more particularly to power head assemblies thereof.

The invention also relates to two stroke internal combustion engines and to the placement of the cylinders and the exhaust passage in an engine block in a power head assembly of an outboard motor so as to minimize the overall size of the outboard motor, and to the placement and mounting on such an engine block of each of a starter motor, a throttle control linkage, an intake air silencer, a fuel pump, and one or more carburetors so as to also minimize the overall size of the outboard motor.

The invention also relates to outboard motors and to arrangements for preventing unauthorized use thereof.

Attention is directed to the following U.S. Pat. Nos.:

4,993,369 issued Feb. 19, 1991

4,594,970 issued Jun. 17, 1986

SUMMARY OF THE INVENTION

The invention provides an outboard motor including a fore and aft center plane and comprising a powerhead assembly including a two stroke internal combustion engine including a cylinder block including a port side, a starboard side, a plurality of vertically aligned cylinders each including an axis extending at an angle to the center plane and to one of the port and starboard sides, and an exhaust port on the other of the port and starboard sides, and an exhaust gas passage including a main portion extending vertically adjacent the center plane, and a like plurality of elbow portions connecting the exhaust ports to the main portion.

The invention also provides an outboard motor comprising a transom bracket adapted to be attached to a boat transom, a swivel bracket connected to the transom bracket for tilting movement relative thereto about a horizontal axis, a propulsion unit, a king pin fixedly connected to the propulsion unit and rotatably connected to the swivel bracket about a vertical axis to afford steering movement of the propulsion unit relative to the swivel bracket and to provide for tilting movement of the propulsion unit relative to the transom bracket, a steering arm fixed to the king pin for steering movement in common with the king pin, a mounting bracket fixed to the steering arm for steering movement in common therewith, and a key operated ignition switch fixedly supported by the mounting bracket and connected to the engine to enable operation thereof.

The invention also provides an outboard motor comprising an engine including a crank case cover, and an air silencer supported on the crank case cover in forward relation thereto and releasably connected to the crank case cover.

The invention also provides an outboard motor having a fore and aft center plane and comprising an engine including a crank case cover, a first fuel pump supported by the crank case cover in forward relation thereto and on one side of the center plane and including an inlet and an outlet, and a second fuel pump supported by the crank case cover in forward relation thereto and on the other side of the center plane and including an inlet and an outlet.

The invention also provides an outboard motor having a fore and aft center plane and comprising an engine including a cylinder block, and a crank case cover fixed to the cylinder block and defining, with the cylinder block, first and second sealed crank case chambers, a first fuel pump supported by the crank case cover in forward relation thereto and on one side of the center plane and including a fuel pumping chamber comprising an inlet adapted to be connected to a fuel source, and an outlet, and a pressure pulse chamber communicating with the first sealed crank case chamber, and a second fuel pump supported by the crank case cover in forward relation thereto and on the other side of the center plane and including a fuel pumping chamber comprising an inlet connected to the outlet of the first fuel pump, and an outlet, and a pressure pulse chamber communicating with the second sealed crankcase chamber.

The invention also provides an outboard motor having a fore and aft center plane and comprising an engine including a cylinder block, and a crank case cover fixed to the cylinder block and defining, with the cylinder block, first and second sealed crank case chambers, an air silencer supported on the crank case cover in forward relation thereto and releasably connected to the crank case cover, a first fuel pump supported by the crank case cover in forward relation thereto, in rearward relation to said air silencer, and on one side of the center plane and including an inlet adapted to be connected to a fuel source, an outlet, and a second fuel pump supported by the crank case cover in forward relation thereto, in rearward relation to said air silencer, and on the other side of the center plane and including an inlet connected to the outlet of the first fuel pump, and an outlet, a device connected to the outlet of the second fuel pump for receiving pressure oil, for pumping oil from an oil source, for mixing the pumped oil with the pressure fuel, and an outlet for supplying the mixed fuel and oil to a device for feeding the fuel/oil mixture to the engine.

The invention also provides an outboard motor comprising an engine block assembly having port and starboard sides and comprising a crank case cover, a carburetor supported by the engine block assembly on one of the port and starboard sides and including a movably mounted throttle valve, a throttle control lever movably supported by the engine block assembly on the other of the port and starboard sides, a throttle controlling cross shaft supported by the crank case cover in forwardly spaced relation thereto and for rotation about a horizontal axis and including a first end operably connected to the throttle valve to effect movement thereof between open and closed positions in response to rotation of the cross shaft, and a second end operably connected to the throttle control lever for rotation of the cross shaft in response to pivotal movement of the throttle control lever.

Other features and advantages of the invention will become known by reference to the following general description and claims and the accompanying drawings.

BRIEF DESCRIPTION OF THE DRAWINGS

FIG. 2 is an enlarged port side elevational view, with portions broken away, showing the powerhead assembly area of the outboard motor shown in FIG. 1.

Figure 8:
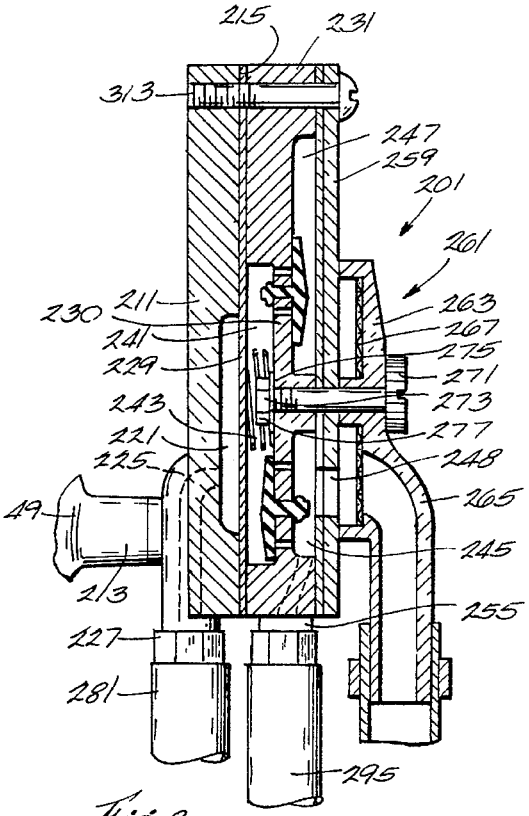
FIG. 8 is a fragmentary sectional view taken along line 8—8 of FIG. 7.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 1:
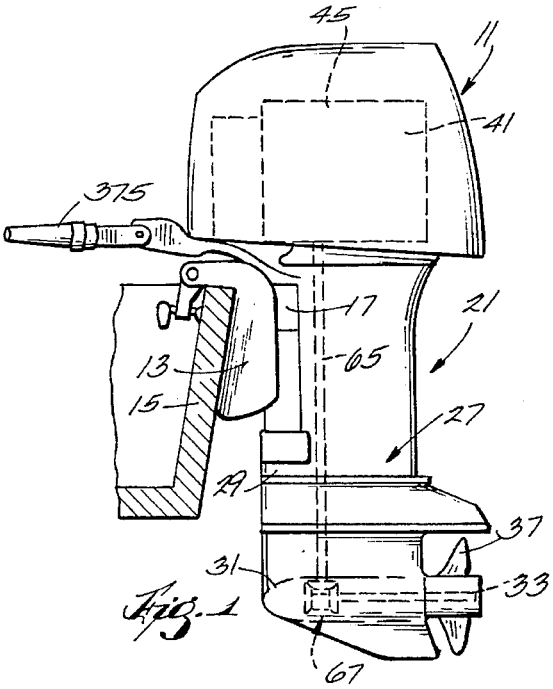
FIG. 1 is a side elevational view of an outboard motor which includes a powerhead assembly incorporating various of the features of the invention.

Shown in FIG. 1 of the drawings is an outboard motor 11 including a transom bracket 13 which is adapted to be mounted on a boat transom 15 and a swivel bracket 17 which is connected to the transom bracket 13 for tilting movement about a horizontal axis relative to the transom bracket 13. The outboard motor 11 also includes a propulsion unit 21 unit which is pivotally connected to the swivel bracket 17 about a vertical axis for steering movement relative thereto. Thus the propulsion unit 21 is both steerable and tiltable relative to the boat.

The steering connection of the swivel bracket 17 to the propulsion unit 21 includes (see FIG. 2) a king pin 23 which is pivotally received in a king pin bore in the swivel bracket 17 and which is fixed to the propulsion unit 21 through rubber isolation mounts, as disclosed in U.S. application Ser. No. 126,549, filed Sep. 24, 1994 and incorporated herein by reference. The king pin 23 is also fixed to a forwardly extending steering arm 25.

The propulsion unit includes a lower unit 27 including a drive shaft or exhaust housing 29 which includes upper and lower ends and which, at the lower end thereof, is fixed to a gear case 31 which forms part of the lower unit 27. Rotatively supported in the gear case 31 is a propeller shaft 33 which lies in and defines (see FIG. 4) a fore and aft vertical center plane 35 and which carries a propeller 37. While any suitable exhaust housing construction can be employed, it is preferred to use the construction disclosed in U.S. application Ser. No. 255,096, filed Jun. 7, 1994.

Fixedly connected to the upper end of the drive shaft or exhaust housing 29 is a power head or power head assembly 41.

The power head assembly 41 includes (see FIG. 2) a two-stroke internal combustion engine 43 comprising an engine block assembly 45 including a cylinder block 47, a crank case cover 49, and a cylinder head 51. More particularly, the cylinder block 47 and the crank case cover 49 define a crank case 61 which rotably supports a vertically extending crank shaft 63 which, at the lower end thereof, is drivingly connected to (see FIG. 1) a drive shaft 65 which extends through the drive shaft housing 29 and which, in the gear case 31, is connected through a transmission 67 with the propeller shaft 33. The crank shaft 63 also extends above the upper end of the engine block assembly 45 and has fixed thereto (see FIG. 3) a fly wheel 69 including a starting gear 71. The cylinder block 47 and crank case cover 49 subdivide the crank case 61 into a series of sealed crank case chambers equal in number to the number of engine cylinders.

Figure 4:
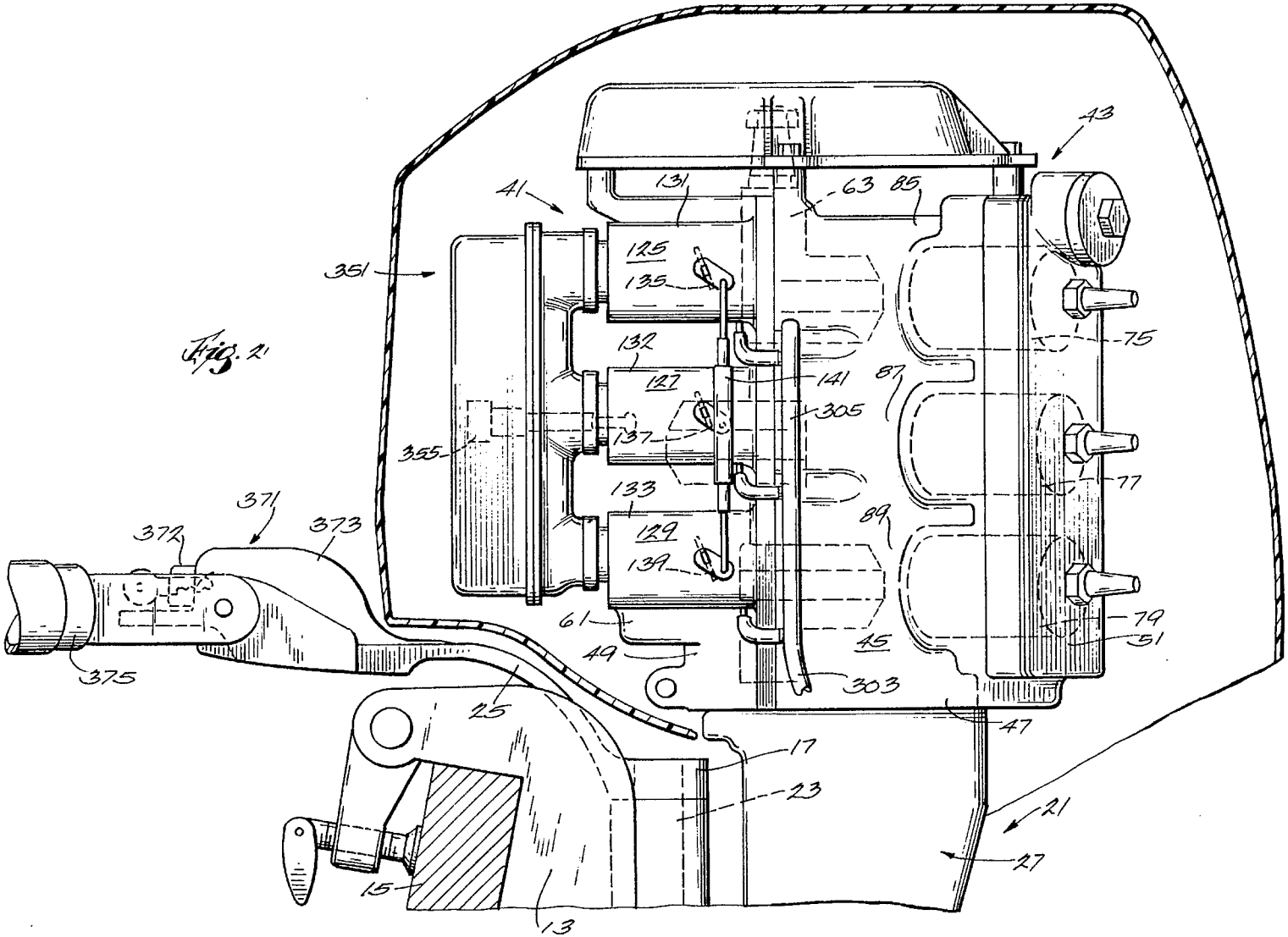
FIG. 4 is a top plan view, with portions in section, of the powerhead assembly area of the outboard motor shown in FIG. 1.

The cylinder block 47 also defines a plurality of cylinders. In the disclosed construction, the cylinder block 47 defines (see FIG. 2) three cylinders 75, 77, and 79 which respectively extend from associated crank case chambers 85, 87, and 89. The cylinders 75, 77, and 79 are vertically aligned and extend, as shown in FIG. 4, at an angle to the fore and aft center plane 35. While other angles could be employed, in the disclosed construction, the cylinders 75, 77, and 79 extend at a 30° angle to the center plane 35 and rearwardly toward the port side.

The cylinders 75, 77, and 79 each include, on the inner or starboard side thereof, adjacent the fore and aft center plane 35, (see FIG. 3) respective exhaust ports 95, 97, and 99.

The cylinder block 47 also includes an exhaust gas passage portion 101 which includes therein an exhaust passage 103 including a main or vertical portion 105 which extends in parallel relation to and adjacent the fore and aft center plane 35 and which also includes, for each of the exhaust ports 95, 97, and 99, an elbow portion 115, 117, and 119 which extends between the associated exhaust ports 95, 97, and 99 and the vertically extending main portion 105. The elbow portions 115, 117, and 119 include only a single change in direction i.e. only one turn from a horizontal direction extending radially from the associated cylinder axis to a vertical direction, thus reducing resistance to exhaust gas flow from the cylinders.

The engine 43 also includes, for each of the cylinders 75, 77, and 79, a fuel feeding arrangement which, in the disclosed construction, comprises (see FIG. 2) three carburetor 125, 127, and 129 for feeding a fuel-oil mixture to the respectively associated crank case chambers 85, 87, and 89. In order to reduce the fore and aft length of the power head assembly 41, the carburetors 125, 127, and 129 are mounted on the engine block 47 on the side remote from the fore and aft center plane, i.e., on the port side of the engine block 47. The carburetors 125, 127, and 129 can be of any conventional construction and respectively include air induction tubes 131, 132, and 133 respectively including throttle valves 135, 137, and 139 which are rotatable in unison about respective horizontal axis extending perpendicularly to the center plane 35 and between open and closed positions through a vertically extending link 141 which is located on the outer side of the carburetors and which is connected to each of the throttle valves 135, 137, and 139.

Figure 5:
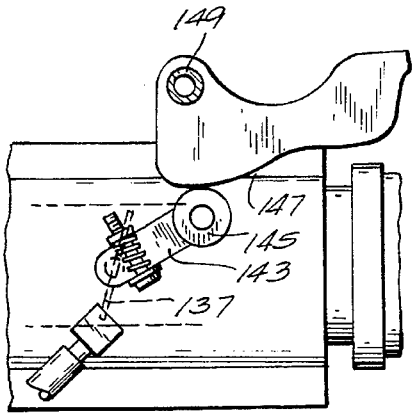
FIG. 5 is an enlarged fragmentary view of a portion of the powerhead assembly included in the outboard motor shown in FIG. 1.

The middle or center carburetor 127 also includes, on the inner side thereof (see FIG. 5), a lever 143 which is fixed to the associated throttle valve 137 for common movement and which includes, at the outer end thereof, a roller or cam follower 145 engageable with a cam surface 147 fixed for common movement on the port end of a horizontally extending throttle controlling cross shaft or rod 149 which is supported for rotation by the crank case cover 49 in forwardly spaced relation therefrom by (see FIG. 3) a pair of laterally-spaced brackets or posts or studs 151 (one shown) extending integrally from and forming part of the crank case cover 49 which is cast unitarily in one piece.

Figure 3:
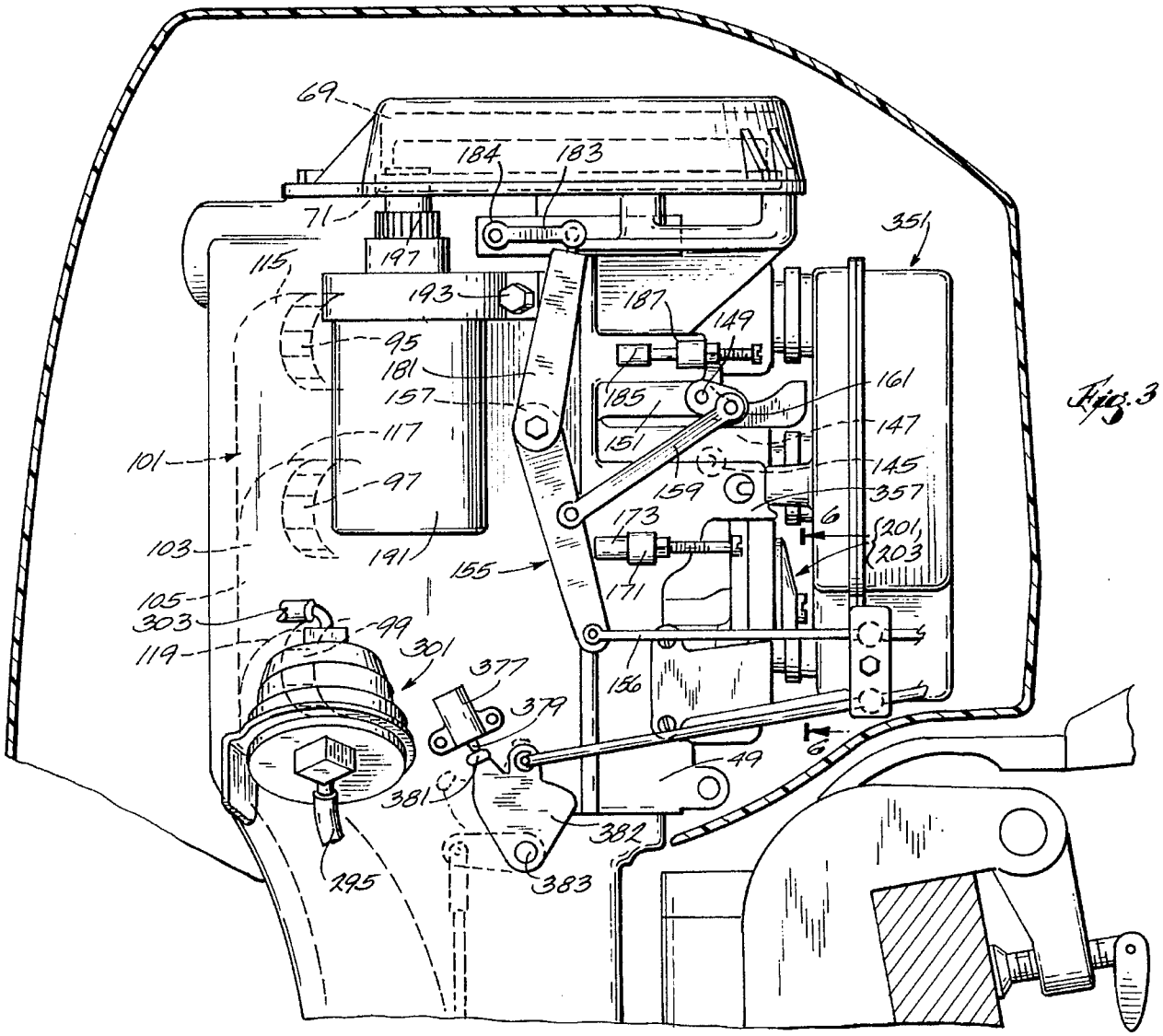
FIG. 3 is an enlarged starboard side elevational view, with portions broken away, of the powerhead assembly area shown in FIG. 1.

At its other or starboard end, the throttle controlling cross shaft 149 is operably connected, as shown in FIG. 3 and as will be explained, to a main throttle control lever 155 which is pivotally mounted on a boss 157 integrally formed on the cylinder block 47 on the starboard side thereof opposite from the carburetors 125, 127, and 129. The throttle control lever 155 extends downwardly and forwardly from its pivotal mounting and, at its lower end, is adapted to be connected to a throttle controlling push-pull cable 156. Intermediate the pivot mounting and the outer or lower end thereof, the throttle control lever 155, is pivotally connected to one end of an upwardly and forwardly extending elongated link 159 which, at the other end thereof, is pivotally connected to one end of a relatively short upwardly and rearwardly extending link 161 which, at the opposite end thereof, is fixedly connected to the starboard end of the cross shaft 149 for common rotation therewith. Thus, rearward movement of the outer or lower end of the throttle control lever 155 (i.e., clockwise movement) causes rotation of the cross shaft 149 which, in turn, operating through the cam surface 147 and cam follower 145, causes opening movement of the carburetor throttle valves 135, 137, and 139.

Forward movement of the outer or lower end of the throttle control lever 155 correspondingly causes closing movement of the throttle valves 135, 137, and 139.

Mounted on a bracket 171 extending from the one-piece crank case cover 49 is an adjusting screw or stop 173 having a rearward end which is engageable with the throttle control lever 155 to limit forward movement thereof toward the throttle closing position.

Coaxially pivotally mounted on the cylinder block 47 with the main throttle control lever 155 is a spark timing control lever 181 which, in general, extends upwardly and forwardly, and, at its outer or upper end, is pivotally connected to one end of a horizontally extending link 183 which, in turn, is connected to a spark timing ring 184 and which, in response to fore and aft movement of the link 183, occurring incident to rotational movement of the spark timing control lever 181, causes adjustment in the timing of spark generation.

Forward movement of the spark timing control lever 181 (i.e., clockwise movement) is limited by an adjustment screw or stop 185 which is adjustably mounted on a bracket 187 extending integrally form the one-piece crank case cover 49, and which includes a rearward end engageable with the spark control lever 181 to limit forward movement thereof.

The throttle control lever 155 and the spark timing control lever 181 are operably connected together by suitable yieldable means, such as a helical spring (not shown) such that initial operating movement (i.e. rearward movement of the lower end thereof) of the throttle control lever 155 causes simultaneous movement (forward movement of the upper end thereof) of the spark timing control lever 181. After such initial movement, the spark timing control lever 181 engages the stop 185 to limit further forward movement of the spark timing control lever 181. However, the yieldable connection between the throttle control lever 155 and the spark timing control lever 181 provides for continued rearward movement of the throttle control lever 155 to further open the throttle valves 125, 127, and 129, while the spark timing control lever 181 remains stationary in engagement with the stop 185.

Upon return (forward) movement of the throttle control lever 155 to progressively close the throttle valves 135, 137, and 139, the throttle control lever 155 initially moves forwardly without movement of the spark timing control lever 181. However, the last increment of forward movement of the throttle movement control lever 155 (corresponding to the initial rearward operation of the throttle control lever 155) causes simultaneous rearward movement of the spark timing control lever 181 away from the stop 185 and until the throttle control lever 155 engages the throttle stop 173 when the throttle valves 135, 137, and 139 are in their closed position.

Thus, in order to avoid excessive structural build-up on the outer side of the carburetors 125, 127, and 129 and thereby lessen the width of the outboard motor, the main control lever 155 for the throttle valves 135, 137, and 139 is located on the opposite side of the engine 43 from the carburetors 125, 127, and 129.

Located rearwardly of the pivotal mounting of the throttle control and spark timing control levers 155 and 181, and forwardly of the exhaust passage portion 101 of the cylinder block 47, is (see FIG. 3) a starter motor 191 which is fixed on the cylinder block 47 by (see FIGS. 3 and 4) a pair of bolts 193 threaded into a pair of bosses 195 formed integrally on the cylinder block 47. The starter motor 191 extends generally vertically and, at the upper end thereof, includes (see FIG. 3) a starter pinion 197 which, in response to electrical actuation of the starter motor 191, engages the fly wheel starting gear 71 to initiate engine operation. Any suitable starter motor construction can be employed.

It is particularly noted that the rearward inclination of the cylinders 75, 77, and 79 to the port side affords the disclosed mounting of the starter motor 191 without excessively increasing the width of the power head assembly 41. It is also particularly noted that the operating pivotal movement of the throttle control lever 155 and the spark timing control lever 181 occur in the area forwardly of the pivotal mounting thereof, thus permitting location of the starter motor 191 in adjacent relation to such pivotal mounting and between such pivotal mounting and the exhaust gas passage portion 101 of the cylinder block 47 without incurring any increase in the fore and aft length of the power head assembly 41.

Figure 6:
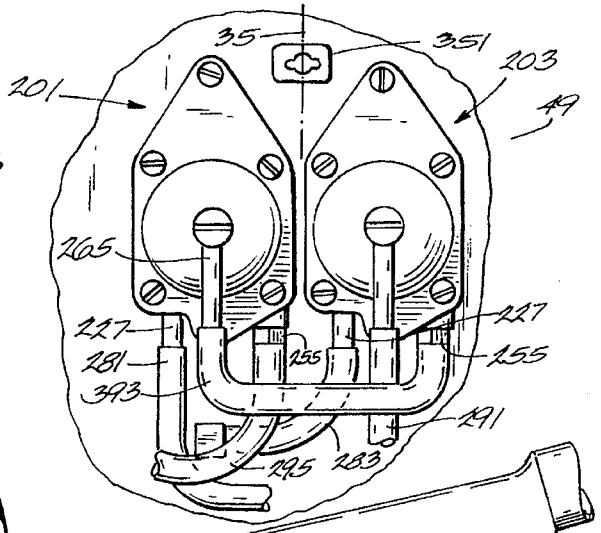
FIG. 6 is a fragmentary sectional view taken along line 6—6 of FIG. 3.
Figure 4:
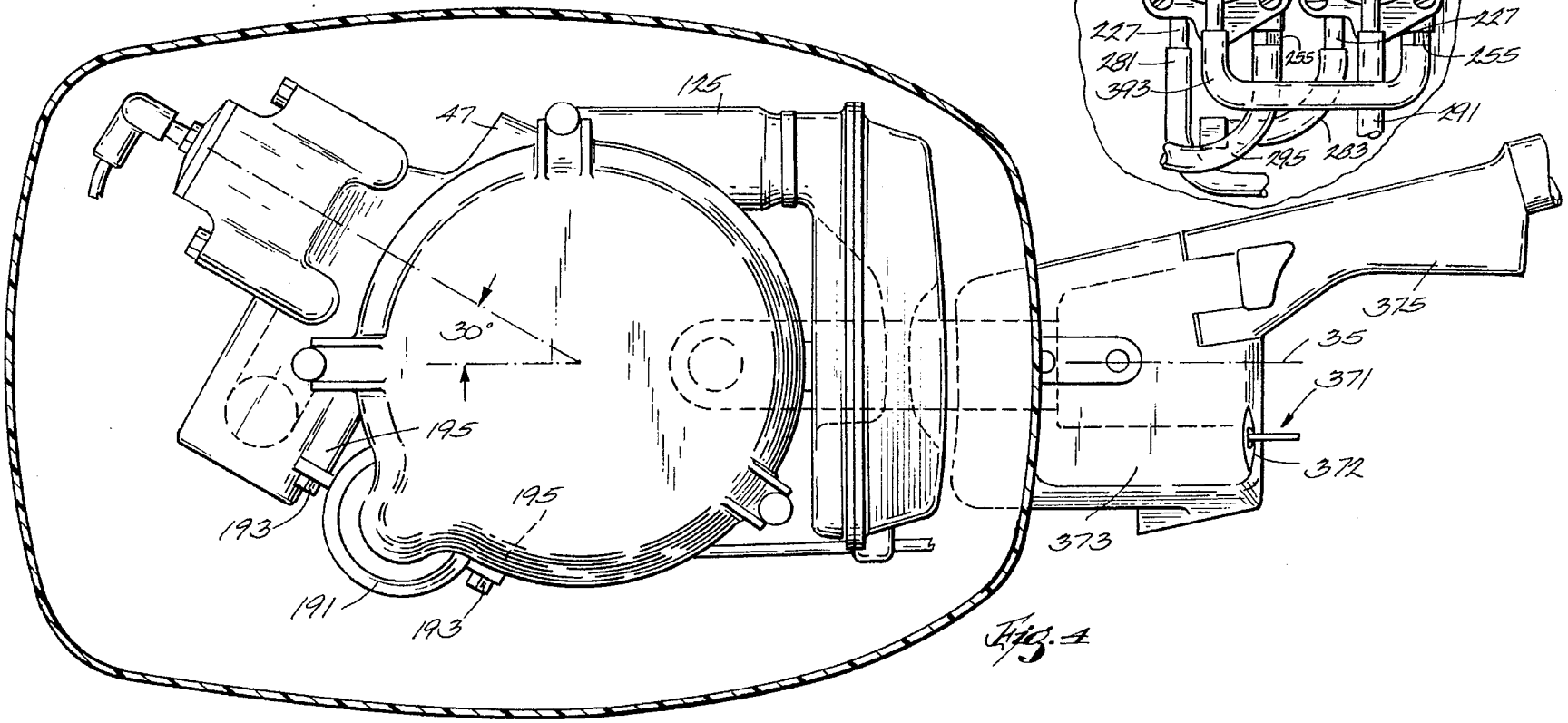

Mounted on the crank case cover 49 in forward relation thereto and below the throttle control cross shaft 149 are (see FIG. 6) a pair of flat pancake-like, series connected, fuel pumps 201 and 203 which are arranged in side-by-side relation, one on each side of the engine fore and aft center plane 35.

Figure 7:
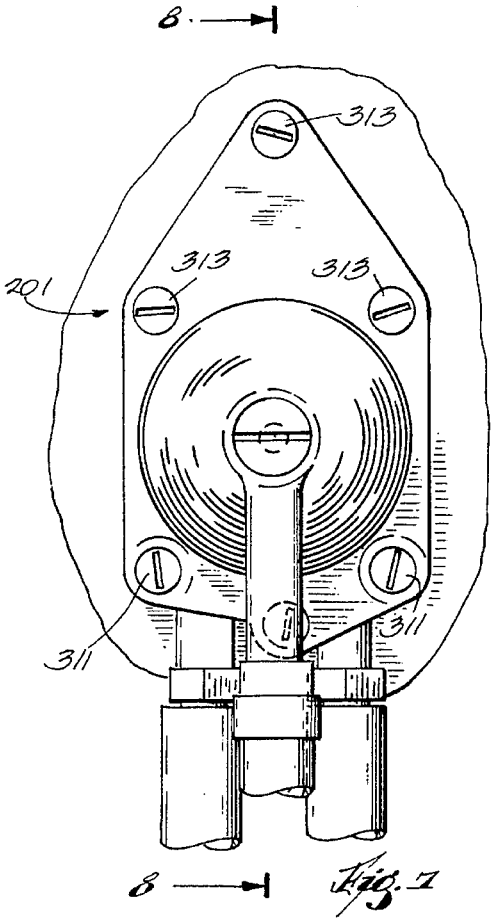
FIG. 7 is a fragmentary enlarged view of one of the components shown in FIG. 6.

Each of the fuel pumps 201 and 203 is identically constructed and, as shown best in FIGS. 7 and 8, includes a metallic base member 211 which is fixed (by assembly bolts still to be described) to a pair of suitable laterally spaced bosses 213 (one shown) integrally formed as part of the one piece crank case cover 49. The base member 211 includes a forward surface 215 which is generally planar except for a pressure pulse recess or void or chamber 221 formed therein. The pressure pulse chamber 221 communicates through an internal conduit or passage 225 in the base member 211 with an external nipple 227.

Each of the fuel pumps 201 and 203 also includes a diaphragm 229 which extends across the forward surface 215 of the base member 211 to complete the pressure pulse chamber 221 and which is unbroken except for holes accommodating the assembly bolts still to be described.

Fixed to the other side of the diaphragm 229 is a second member 231 having a rearward surface which engages the diaphragm 229 and which is centrally dished or recessed by a wall portion 230 to provide, with the diaphragm 229, a fuel pumping chamber 241. Located in the fuel pumping chamber 241 is a spring 243 biasing the diaphragm 229 away from the second member 231 and toward the base member 211.

The second member 231 also includes on the front surface thereof inlet and outlet check valve conduits or recesses 245 and 247 which communicate with the pumping chamber 241 and which respectively constitute internal fuel inlet and outlet passages which are formed in the second member 231. The outlet conduit 247 communicates with an external nipple 255 and the inlet conduit 245 terminates or opens into a forward surface of the second member 231. Suitable one way check valves are provided in the inlet and outlet recesses or conduits 245 and 247.

Each of the fuel pumps 201 and 203 also includes a cover plate or member 259 which, except for an inlet opening 248 communicating with the inlet recess or conduit 245, closes the check valve recesses 245 and 247. Each of the fuel pumps 201 and 203 also includes a combined cover and filter assembly 261 including a cup shaped member 263 which engages the forward surface of the cover plate 259 and communicates with the inlet conduit or recess 245 through the opening 248 and which is provided with an intake nipple 265. The combined assembly 261 includes a filter 267 located in the cup shaped member 263 and between the inlet opening 248 in the cover plate 259.

The cover and filter assembly 261 is removably secured to the second member 231 by a bolt 271 which is threaded into a non-ferrous bushing 273 extending through a central hole in the wall portion 230 of the second member 231 and has a flange 275 engaging the inside surface of the fuel pumping chamber 241 and a rearwardly extending projection 277 about which the end of the helical spring 243 is located.

The pressure pulse chamber 221 of the fuel pump 201 communicates through the associated nipple 227 and through a conduit 281 with one of the sealed crank case chambers 85, 87, and 89 and the pulse pressure chamber 221 of the fuel pump 203 communicates through the associated nipple 227 and through (see FIG. 6) a conduit 283 with another of the sealed crankcase chambers 85, 87, and 89. Thus, during engine rotation, there is a period during which the fuel pump 201 is delivering fluid under pressure and the fuel pump 203 is calling for inflow, whereby the fuel pressure created by the series connection of the fuel pumps 201 and 203 is greater than the pressure otherwise available from a single pump.

The inlet nipple 265 of the fuel pump 203 is connected by a suitable conduit 291 to a suitable source of fuel (not shown). The outlet nipple 255 of the fuel pump 203 is connected through another conduit 393 to the inlet nipple 265 of the fuel pump 201.

The outlet nipple 255 of the fuel pump 201 is connected by a conduit 295 to (see FIG. 3) an oil pump and mixing device 301 which pumps oil from a suitable source (not shown) in response to the flow of pressurized fuel there through, which mixes the pumped oil with the fuel under pressure and flowing through the device 301, and which is connected by another conduit 303 to a fuel rail 305 which, in turn, communicates with the fuel bowls (not shown) of the carburetors 125, 127 and 129.

The base member 211, the diaphragm 229, the cover plate 259 and the second member 231 are assembled together to form a fuel pump by three bolts (see FIG. 7) and a pair of bolts 311 which also fixedly attach the fuel pump to the crank case cover 49.

Also forming a part of the power head assembly 41 is (see FIG. 2) an incoming combustion air silencer 351 which is located in forwardly spaced relation from the fuel pumps 201 and 203 and which is supported, in part, by a telescopic engagement on the ends of the carburetor air induction tubes 131, 132, and 133 and by a latch member 355 which passes through the air silencer 351 and which releasably engages (see FIG. 3) a mounting post 357 integrally formed as part of the one-piece crank case cover 49 and extending forwardly therefrom along the fore and aft center plane 35 and below the throttle control cross shaft 149 and above the bosses 213 supporting the fuel pumps 201 and 203. More particularly, the mounting post 357 extends (see FIG. 6) between upper fuel pump portions which diverge from each other. While various air silencer constructions and mounting arrangements can be employed, it is preferred that the air silencer 351 be constructed and supported or mounted as disclosed in U.S. application Ser. No. 255,336, filed Jun. 7, 1994, which is incorporated herein by reference.

The outboard motor also includes (see FIGS. 2 and 4) a key operated ignition switch 371 which is mounted on a bracket 373 which is fixed to the steering arm 25 and which also fixedly supports a tiller arm 375. Any suitable ignition switch construction can be employed. In the disclosed construction, the ignition switch 371 comprises a key operated off-on-start switch. The start condition of the ignition switch 371 energizes the electrical starter motor 191 included in the outboard motor 11. Preferably, a neutral start only lock-out is also included. In this regard, (see FIG. 3) a normally open interruption switch 377, including an actuating button 379, is electrically connected between the ignition switch 371 and the starter motor 191 and is fixedly mounted on the engine block 47 in position to enable engagement of the actuating button 379, and consequent closure of the circuit to the starter motor 191, by a cam surface 381 on a member 382 fixed on a rotable transmission control link 383. Thus, when the transmission 67 is not in neutral, i.e., when the transmission 67 is either in forward or reverse drive, the cam surface 381 is spaced from the actuator button 379, the circuit to the starter motor 191 is open, and actuation of the ignition switch 371 to the start position is inoperative to electrically energize the starter motor 191. However, when, and only when, the transmission 67 is in neutral, the cam surface 381 engages the switch actuating button 379, thereby closing the interruption switch 379 to close the circuit to the starter motor 191 and permitting electrical energization thereof.

If desired, the outboard motor can be provided with a rope starter (not shown) in place of the electrical starter motor 191 and, in this case, the key operator ignition switch 371 can be a simple off-on switch. Use of the key operated ignition switch 371 on the bracket 373 on the steering arm 25 of the outboard motor 11 prevents unauthorized use of the outboard motor 11.

Various of the features of the invention are set forth in the following claims.

We claim:

1. An outboard motor including a fore and aft center plane and comprising a powerhead assembly including a two stroke internal combustion engine including a cylinder block including a port side, a starboard side, a plurality of vertically aligned cylinders arranged in only a single bank and each including an axis extending at an angle to said center plane and to one of said port and starboard sides, and an exhaust port on the other of said port and starboard sides, and an exhaust gas passage including a main portion extending vertically adjacent said center plane, and a like plurality of elbow portions connecting said exhaust ports to said main portion.

2. An outboard motor in accordance with claim 1 wherein said elbow portions include only one change in direction.

3. An outboard motor including a fore and aft center plane and comprising a powerhead assembly including a two stroke internal combustion engine including a cylinder block including a port side, a starboard side, a plurality of vertically aligned cylinders each including an axis extending at an angle to said center plane and to one of said port and starboard sides, and an exhaust port on the other of said port and starboard sides, and an exhaust gas passage including a main portion extending vertically adjacent said center plane, and a like plurality of elbow portions connecting said exhaust ports to said main portion, and a like plurality of carburetors mounted on said cylinder block on said one of said port and starboard sides.

4. An outboard motor including fore and aft center plane and comprising a powerhead assembly including a two stroke internal combustion engine including a cylinder block including a port side, a starboard side, a plurality of vertically aligned cylinders each including an axis extending at an angle to said center plane and to one of said port and starboard sides, and an exhaust port on the other of said port and starboard sides, and an exhaust gas passage including a main portion extending vertically adjacent said center plane, and a like plurality of elbow portions connecting said exhaust ports to said main portion, a like plurality of carburetors mounted on said cylinder block on said one of said port and starboard sides, a throttle control lever mounted on said other of said port and starboard sides, and a transverse throttle control shaft connected between said carburetors and said throttle control lever.

5. An outboard motor including a fore and aft center plane and comprising a powerhead assembly including a two stroke internal combustion engine including a cylinder block including a port side, a starboard side, a plurality of vertically aligned cylinders each including an axis extending at an angle to said center plane and to one of said port and starboard sides, and an exhaust port on the other of said port and starboard sides, and an exhaust gas passage including a main portion extending vertically adjacent said center plane, and a like plurality of elbow portions connecting said exhaust ports to said main portion, and a starter motor supported by said cylinder block on said other of said port and starboard sides.

6. An outboard motor comprising a transom bracket adapted to be attached to a boat transom, a swivel bracket connected to said transom bracket for tilting movement relative thereto about a horizontal axis, a propulsion unit, a king pin fixedly connected to said propulsion unit and rotatably connected to said swivel bracket about a vertical axis to afford steering movement of said propulsion unit relative to said swivel bracket and to provide for tilting movement of said propulsion unit relative to said transom bracket, a steering arm fixed to said king pin for steering movement in common with said king pin, a mounting bracket fixed to said steering arm for steering movement in common therewith, and an ignition switch fixedly supported by said mounting bracket and connected to said engine to enable operation thereof.

7. An outboard motor in accordance with claim 6 wherein said propulsion unit includes an electric starter motor, and wherein said ignition switch is operable between off, on, and start positions.

8. An outboard motor in accordance with claim 6 wherein said ignition switch is operable between off and on positions.

9. An outboard motor in accordance with claim 6 wherein said propulsion unit includes a reversing transmission operable between a neutral position and a drive position, and further including a normally open switch in circuit between said ignition switch and said starter motor, and a member engageable with said normally open switch to effect closure of said normally open switch to electrically connect said ignition switch and said starter motor when and only when said transmission is in said neutral position.

10. An outboard motor comprising an engine including a crank case cover, a carburetor, and an air silencer communicating with said carburetor and supported on said crank case cover in forward relation thereto and releasably connected to said crank case cover independently of said carburetor.

11. An outboard motor having a fore and aft center plane and comprising an engine including a crank case cover including a mounting post located adjacent said center plane, and an air silencer supported on said mounting post in forward relation to said crank case cover, and a latch member releasably connecting said air silencer to said mounting post.

12. An outboard motor having a fore and aft center plane and comprising an engine including a crank case cover, a first fuel pump supported by said crank case cover in forward relation thereto and on one side of said center plane and including an inlet and an outlet, and a second fuel pump supported by said crank case cover in forward relation thereto and on the other side of said center plane and including an inlet and an outlet.

13. An outboard motor in accordance with claim 11 and further including a device connected to said outlet of said second fuel pump for receiving pressure fuel, for pumping oil from an oil source, for mixing the pumped oil with the pressure fuel, and including an outlet for supplying the mixed fuel and oil to a device for feeding the fuel/oil mixture to the engine, and an air silencer releaseably supported by said crank case cover in forward relation to said first and second fuel pumps.

14. An outboard motor having a fore and aft center plane and comprising an engine including a cylinder block, and a crank case cover fixed to said cylinder block and defining, with said cylinder block, first and second sealed crank case chambers, a first fuel pump supported by said crank case cover in forward relation thereto and on one side of said center plane and including a fuel pumping chamber comprising an inlet adapted to be connected to a fuel source, and an outlet, and a pressure pulse chamber communicating with said first sealed crank case chamber, and a second fuel pump supported by said crank case cover in forward relation thereto and on the other side of said center plane and including a fuel pumping chamber comprising an inlet connected to said outlet of said first fuel pump, and an outlet, and a pressure pulse chamber communicating with said second sealed crankcase chamber.

15. An outboard motor in accordance with claim 14 and further including a device connected to said outlet of said second fuel pump for receiving pressure fuel, for pumping oil from an oil source, for mixing the pumped oil with the pressure fuel, and including an outlet for supplying the mixed fuel and oil to a device for feeding the fuel/oil mixture to the engine.

16. An outboard motor having a fore and aft center plane and comprising an engine including a cylinder block, and a crank case cover fixed to said cylinder block and defining, with said cylinder block, and second sealed crank case chambers, an air silencer supported on said crank case cover in forward relation thereto and releasably connected to said crank case cover, a first fuel pump supported by said crank case cover in forward relation thereto, in rearward relation to said air silencer, and on one side of said center plane and including an inlet adapted to be connected to a fuel source, an outlet, and a second fuel pump supported by said crank case cover in forward relation thereto, in rearward relation to said air silencer, and on the other side of said center plane and including an inlet connected to said outlet of said first fuel pump, and an outlet, and a device connected to said outlet of said second fuel pump for receiving pressure fuel, for pumping oil from an oil source, for mixing the pumped oil with the pressure fuel, and including an outlet for supplying the mixed fuel and oil to another device for feeding the fuel/oil mixture to the engine.

17. An outboard motor comprising an engine block assembly having port and starboard sides and comprising a crank case cover, a carburetor supported by said engine block assembly on one of said port and starboard sides and including a movably mounted throttle valve, a throttle control lever movably supported by said engine block assembly on the other of said port and starboard sides, and a throttle controlling cross shaft supported by said crank case cover in forwardly spaced relation thereto and for rotation about a horizontal axis and including a first end operably connected to said throttle valve to effect movement thereof between open and closed positions in response to rotation of said cross shaft, and a second end operably connected to said throttle control lever for rotation of said cross shaft in response to pivotal movement of said throttle control lever.

18. An outboard motor in accordance with claim 17 wherein said throttle control lever extends forwardly and downwardly when said throttle valve is closed, and wherein said throttle control lever extends principally downwardly when said throttle valve is open.

19. An outboard motor in accordance with claim 17 and further including a throttle stop adjustably mounted on said crank case cover in position for engagement with said throttle control lever to limit movement thereof in the direction closing said throttle valve.

20. An outboard motor in accordance with claim 17 and further including a spark timing control lever mounted on said engine block assembly and extending upwardly and forwardly when said throttle valve is closed, having an outer end adapted to be connected to a spark timing variation device, and being moveable rearwardly in response to initial movement of said throttle control lever in the direction opening said throttle valve.

* * * * *